US010563485B2

(12) United States Patent
Least et al.

(10) Patent No.: US 10,563,485 B2
(45) Date of Patent: Feb. 18, 2020

(54) SHUNT TUBE ASSEMBLY ENTRY DEVICE

(71) Applicant: Halliburton Energy Services, Inc., Houston, TX (US)

(72) Inventors: Brandon Thomas Least, Dallas, TX (US); Stephen Michael Greci, McKinney, TX (US); Jean Marc Lopez, Plano, TX (US); Jan Veit, Plano, TX (US); Luke William Holderman, Plano, TX (US); Maxime Coffin, Pau (FR); Andrew Penno, Porcheres (FR)

(73) Assignee: Halliburton Energy Services, Inc., Houston, TX (US)

( * ) Notice: Subject to any disclaimer, the term of this patent is extended or adjusted under 35 U.S.C. 154(b) by 149 days.

(21) Appl. No.: 15/902,647

(22) Filed: Feb. 22, 2018

(65) Prior Publication Data

US 2018/0179863 A1 Jun. 28, 2018

Related U.S. Application Data

(62) Division of application No. 13/879,311, filed as application No. PCT/US2012/041666 on Jun. 8, 2012, now Pat. No. 9,938,801.

(51) Int. Cl.
*E21B 43/04* (2006.01)
*E21B 43/08* (2006.01)

(52) U.S. Cl.
CPC ..... *E21B 43/04* (2013.01)

(58) Field of Classification Search
CPC ..... E21B 43/04; E21B 43/08
See application file for complete search history.

(56) References Cited

U.S. PATENT DOCUMENTS

| | | | |
|---|---|---|---|
| 5,476,143 | A | 12/1995 | Sparlin et al. |
| 5,868,200 | A | 2/1999 | Bryant et al. |
| 6,749,023 | B2 | 6/2004 | Nguyen et al. |
| 7,207,383 | B2 | 4/2007 | Hurst et al. |
| 7,464,752 | B2 | 12/2008 | Dale et al. |
| 2002/0189809 | A1 | 12/2002 | Nguyen et al. |
| 2003/0159825 | A1 | 8/2003 | Hurst et al. |
| 2003/0221828 | A1 | 12/2003 | McGregor et al. |
| 2005/0200127 | A1 | 9/2005 | Johnson et al. |
| 2007/0246407 | A1 | 10/2007 | Richards et al. |
| 2008/0283238 | A1 | 11/2008 | Richards et al. |
| 2009/0008084 | A1 | 1/2009 | Dybevik et al. |

(Continued)

FOREIGN PATENT DOCUMENTS

| | | | |
|---|---|---|---|
| EP | 2184436 | A2 | 12/2010 |
| WO | 02/097237 | A1 | 12/2002 |
| WO | 2011/002682 | A2 | 1/2011 |

OTHER PUBLICATIONS

Extended European Search Report issued in related European Application No. 12878384, dated Feb. 3, 2016, 7 pages.

(Continued)

*Primary Examiner* — Catherine Loikith
(74) *Attorney, Agent, or Firm* — Scott Richardson; Baker Botts L.L.P.

(57) ABSTRACT

A shunt tube entry device comprises one or more inlet ports, a shroud disposed at least partially about a wellbore tubular, and a shunt tube in fluid communication with the chamber. The shroud defines a chamber between the shroud and the wellbore tubular, and the chamber is in fluid communication with the one or more entry ports.

2 Claims, 13 Drawing Sheets

(56) References Cited

U.S. PATENT DOCUMENTS

| | | | |
|---|---|---|---|
| 2010/0155064 | A1 | 6/2010 | Nutley et al. |
| 2010/0236775 | A1 | 9/2010 | Sevre et al. |
| 2010/0294569 | A1 | 11/2010 | Aldred et al. |

OTHER PUBLICATIONS

Written Opinion issued in related Singapore Application No. 11201407642Q, dated Apr. 12, 2016, 4 pages.
International Search Report and Written Opinion issued in related PCT Application No. PCT/US2012/041666 dated Aug. 13, 2013, 12 pages.
International Preliminary Report on Patentability issued in related PCT Application No. PCT/US2012/041666 dated Dec. 9, 2014, 10 pages.
Extended European Search Report issued in related European Patent Application No. 18199077.1 dated Feb. 28, 2019, 9 pages.

SHUNT TUBE ASSEMBLY ENTRY DEVICE

CROSS-REFERENCE TO RELATED APPLICATIONS

The present application is a divisional of U.S. patent application Ser. No. 13/879,311 filed on Apr. 12, 2013, which is a U.S. National Stage Application of International Application No. PCT/US2012/041666 filed Jun. 8, 2012, both of which are incorporated herein by reference in their entirety for all purposes.

STATEMENT REGARDING FEDERALLY SPONSORED RESEARCH OR DEVELOPMENT

Not applicable.

REFERENCE TO A MICROFICHE APPENDIX

Not applicable.

BACKGROUND

In the course of completing an oil and/or gas well, a string of protective casing can be run into the wellbore followed by production tubing inside the casing. The casing can be perforated across one or more production zones to allow production fluids to enter the casing bore. During production of the formation fluid, formation sand may be swept into the flow path. The formation sand tends to be relatively fine and can erode production components in the flow path. In some completions, the wellbore is uncased, and an open face is established across the oil or gas bearing zone. Such open wellbore (uncased) arrangements are typically utilized, for example, in water wells, test wells, and horizontal well completions.

When formation sand is expected to be encountered, one or more sand screens can be installed in the flow path between the production tubing and the perforated casing (cased) and/or the open wellbore face (uncased). A packer is customarily set above the sand screen to seal off the annulus in the zone where production fluids flow into the production tubing. The annulus around the screen can then be packed with a relatively coarse sand (or gravel) which acts as a filter to reduce the amount of fine formation sand reaching the screen. The packing sand is pumped down the work string in a slurry of water and/or gel and fills the annulus between the sand screen and the well casing/reservoir. In well installations in which the screen is suspended in an uncased open bore, the sand or gravel pack may serve to support the surrounding unconsolidated formation.

During the sand packing process, annular sand "bridges" can form around the sand screen assembly that may prevent the complete circumscribing of the screen structure with packing sand in the completed well. This incomplete screen structure coverage by the packing sand may leave an axial portion of the sand screen exposed to the fine formation sand, thereby undesirably lowering the overall filtering efficiency of the sand screen structure.

One conventional approach to overcoming this packing sand bridging problem has been to provide each generally tubular filter section with a series of shunt tubes that longitudinally extend through the filter section. In the assembled sand screen structure, the shunt tube series forms a flow path extending along the entire length of the sand screen structure. The flow path operates to permit the inflowing packing sand/gel slurry to bypass any sand bridges that may be formed and permit the slurry to enter the annulus between the casing/reservoir beneath a sand bridge, thereby forming the desired sand pack beneath it.

SUMMARY

In an embodiment, a shunt tube entry device comprises one or more inlet ports, a shroud disposed at least partially about a wellbore tubular, and a shunt tube in fluid communication with the chamber. The shroud defines a chamber between the shroud and the wellbore tubular, and the chamber is in fluid communication with the one or more entry ports.

In an embodiment, a shunt tube entry device comprises a plurality of inlet ports, a shroud at least partially disposed about a wellbore tubular, one or more dividers, and one or more shunt tubes. The one or more dividers define a plurality of chambers between the shroud and the wellbore tubular. Each chamber of the plurality of chambers is in fluid communication with one or more of the plurality of inlet ports, and each of one or more shunt tubes is in fluid communication with at least one of the plurality of chambers.

In an embodiment, a method of gravel packing comprises passing a slurry through one or more inlet ports, receiving the slurry within a chamber in fluid communication with the one or more inlet ports, passing the slurry from the chamber into one or more shunt tubes, and disposing the slurry about a sand screen assembly. The chamber is defined by a shroud at least partially disposed about a wellbore tubular, and the one or more shunt tubes are in fluid communication with the chamber.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
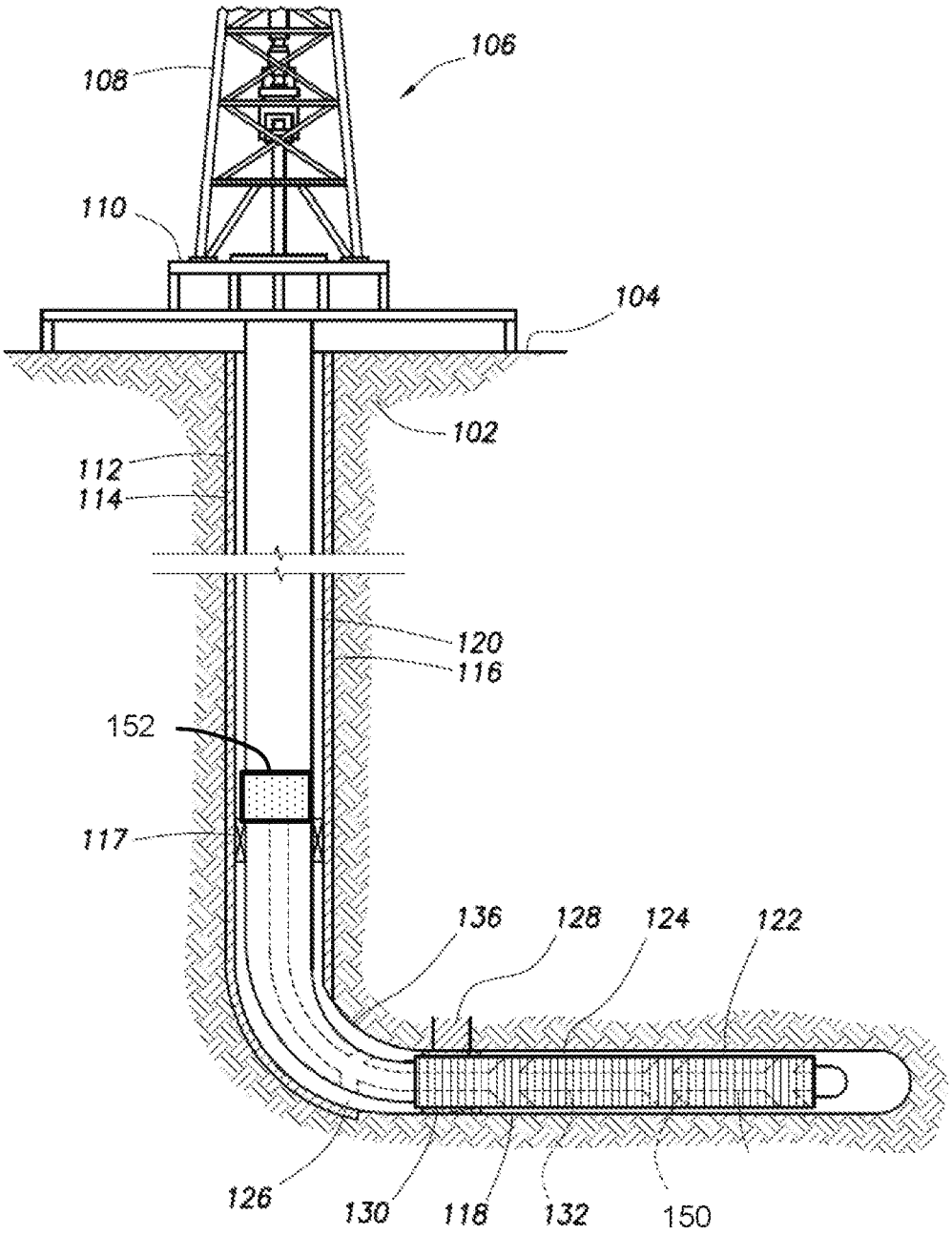
FIG. 1 is a cut-away view of an embodiment of a wellbore servicing system according to an embodiment.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," "upstream," or "above" meaning toward the surface of the wellbore and with "down," "lower," "downward," "downstream," or "below" meaning toward the terminal end of the well, regardless of the wellbore orientation. Reference to inner or outer will be made for purposes of description with "in," "inner," or "inward" meaning towards the central longitudinal axis of the wellbore and/or wellbore tubular, and "out," "outer," or "outward" meaning towards the wellbore wall. As used herein, the term "longitudinal," "longitudinally," "axial," or "axially" refers to an axis substantially aligned with the central axis of the wellbore tubular, and "radial" or "radially" refer to a direction perpendicular to the longitudinal axis. The various characteristics mentioned above, as well as other features and characteristics described in more detail below, will be readily apparent to those skilled in the art with the aid of this disclosure upon reading the following detailed description of the embodiments, and by referring to the accompanying drawings.

When a sand screen system comprising shunt tubes is installed within the wellbore, it is difficult to orient the sand screen system in any particular configuration. For example, when the sand screen system is installed within a deviated or horizontal wellbore section, the shunt tubes may be oriented on the high side of the wellbore or the low side of the wellbore. In some instances, the entire length of the system may be twisted to some degree, making it difficult to know where the entrance to any particular shunt tube is located (e.g., on the high side or the low side of the wellbore). During the course of the gravel packing operation, blockages (e.g., sand bridges, sand deposits, debris accumulations, and the like) may form at or near the entrance to the shunt tube assembly. These blockages may tend to form on the low side of the wellbore, and if the entrance to the shunt tube assembly is located on the low side of the wellbore, the entrance to the shunt tubes may be blocked, impeding flow into the shunt tube assembly.

In order to address the potential for blockages, alternative flow paths may be provided by the entry devices described herein that may allow for a fluid to enter the shunt tubes even if a blockage has formed over a portion of the shunt tube entrance area. The alternative flow paths generally represent an indirect flow of fluid into the shunt tube assembly, which may be beneficial in bypassing or avoiding any blockages. For example, one or more ports may be provided to allow access to a chamber. While the chamber may be formed by any number of features, the chamber can be formed by a shroud disposed at least partially about a wellbore tubular. The ports may be spaced apart on any portion of the shroud to allow some portion of the ports to be clear of any blockage. The chamber may then provide fluid communication into the shunt tube assembly. Accordingly, the ports and the chamber may provide an indirect flow path (e.g., alternative flow paths) into the shunt tube assembly in the event of the blockages. As another example, one or more baffles may be used within a chamber. The baffles may provide a flow regime within the chamber designed to clear any blockages from the chamber, and provide a flow path to the shunt tube assembly. Other designs may include the use of direct openings into the shunt tubes from the chamber in addition to direct exposure of the shunt tubes to the exterior of the entry device. These openings may provide alternative pathways should a blockage impede flow directly into the shunt tubes at the exterior of the entry device. Optional extension tubes may be provided to provide still further alternative flow paths throughout the chamber, allowing for one or more flow paths to be clear of any blockage that may form.

The alternative flow paths may also include the use of multiple chambers arranged in parallel. Multiple inlets can be used with the chambers where the inlets may be circumferentially spaced apart. At least one shunt tube may be connected to each chamber, allowing for an alternate flow path even if an entire chamber is blocked. Similarly, the multiple chambers may be arranged in series. Each of the chambers may then act to filter out any sand, gravel, or debris and limit the extent to which a blockage could form adjacent the shunt tube inlets. Each of these options is discussed in greater detail herein.

Referring to FIG. 1, an example of a wellbore operating environment in which a well screen assembly may be used is shown. As depicted, the operating environment comprises a workover and/or drilling rig 106 that is positioned on the earth's surface 104 and extends over and around a wellbore 114 that penetrates a subterranean formation 102 for the purpose of recovering hydrocarbons. The wellbore 114 may be drilled into the subterranean formation 102 using any suitable drilling technique. The wellbore 114 extends substantially vertically away from the earth's surface 104 over a vertical wellbore portion 116, deviates from vertical relative to the earth's surface 104 over a deviated wellbore portion 136, and transitions to a horizontal wellbore portion 118. In alternative operating environments, all or portions of a wellbore may be vertical, deviated at any suitable angle, horizontal, and/or curved. The wellbore may be a new wellbore, an existing wellbore, a straight wellbore, an extended reach wellbore, a sidetracked wellbore, a multilateral wellbore, and other types of wellbores for drilling and completing one or more production zones. Further, the wellbore may be used for both producing wells and injection wells. The wellbore may also be used for purposes other than hydrocarbon production such as geothermal recovery and the like.

A wellbore tubular 120 may be lowered into the subterranean formation 102 for a variety of drilling, completion, workover, treatment, and/or production processes throughout the life of the wellbore. The embodiment shown in FIG. 1 illustrates the wellbore tubular 120 in the form of a completion assembly string comprising a well screen assembly 122 comprising a shunt tube assembly disposed in the wellbore 114. It should be understood that the wellbore tubular 120 is equally applicable to any type of wellbore tubulars being inserted into a wellbore including as nonlimiting examples drill pipe, casing, liners, jointed tubing, and/or coiled tubing. Further, the wellbore tubular 120 may operate in any of the wellbore orientations (e.g., vertical, deviated, horizontal, and/or curved) and/or types described herein. In an embodiment, the wellbore may comprise wellbore casing 112, which may be cemented into place in at least a portion of the wellbore 114.

In an embodiment, the wellbore tubular 120 may comprise a completion assembly string comprising one or more downhole tools (e.g., zonal isolation devices 117, screens and/or slotted liner assemblies 122, valves, etc.). The one or more downhole tools may take various forms. For example, a zonal isolation device 117 may be used to isolate the various zones within a wellbore 114 and may include, but is not limited to, a packer (e.g., production packer, gravel pack packer, frac-pac packer, etc.). While FIG. 1 illustrates a single screen assembly 122, the wellbore tubular 120 may comprise a plurality of screen assemblies 122. The zonal isolation devices 117 may be used between various ones of the screen assemblies 122, for example, to isolate different gravel pack zones or intervals along the wellbore 114 from each other.

The workover and/or drilling rig 106 may comprise a derrick 108 with a rig floor 110 through which the wellbore tubular 120 extends downward from the drilling rig 106 into the wellbore 114. The workover and/or drilling rig 106 may comprise a motor driven winch and other associated equipment for conveying the wellbore tubular 120 into the wellbore 114 to position the wellbore tubular 120 at a selected depth. While the operating environment depicted in FIG. 1 refers to a stationary workover and/or drilling rig 106 for conveying the wellbore tubular 120 within a land-based wellbore 114, in alternative embodiments, mobile workover rigs, wellbore servicing units (such as coiled tubing units), and the like may be used to convey the wellbore tubular 120 within the wellbore 114. It should be understood that a wellbore tubular 120 may alternatively be used in other operational environments, such as within an offshore wellbore operational environment.

In use, the screen assembly 122 can be positioned in the wellbore 114 as part of the wellbore tubular string 120 adjacent a hydrocarbon bearing formation. An annulus 124 is formed between the screen assembly 122 and the wellbore 114. The gravel slurry 126 may travel through the annulus 124 between the well screen assembly 122 and the wellbore 114 wall as it is pumped down the wellbore around the screen assembly 122. Upon encountering a section of the subterranean formation 102 including an area of highly permeable material 128, the highly permeable area 128 can draw liquid from the slurry, thereby dehydrating the slurry. As the slurry dehydrates in the permeable area 128, the remaining solid particles form a sand bridge 130 and prevent further filling of the annulus 124 with gravel.

As shown schematically in FIG. 1, a shunt tube assembly may comprise one or more shunt tubes used to create an alternative path for gravel around the sand bridge 130. As used herein, shunt tubes may include both transport tubes and packing tubes. The transport tubes 132 and packing tubes 150 may form a branched structure along the length of a screen assembly 122 with the one or more transport tubes 132 forming the trunk line and the one or more packing tubes 150 forming the branch lines. The shunt tubes may be placed on the outside of the wellbore tubular 120 or run along the interior thereof. In use, the branched configuration of the transport tubes 132 and packing tubes 150 may provide the fluid pathway for a slurry to be diverted around a sand bridge. Upon the formation of a sand bridge, a back pressure generated by the blockage may cause the slurry carrying the sand to be diverted through the one or more entry devices 152 and into the transport tubes 132 until bypassing the sand bridge. The slurry may then pass out of the one or more transport tubes 132 into the one or more packing tubes 150. While flowing through the one or more packing tubes 150, the slurry may pass through the perforations in both the packing tubes 150 and an outer shroud, if present, and into annulus 124.

In an embodiment, the entry device 152 is configured to provide an entry for the slurry into the shunt tube assembly. The entry device 152 may serve to provide an alternate pathway for the slurry to enter the shunt tube assembly should a blockage form at the entry to the shunt tube assembly. For example, should a sand bridge form at or near the entrance to the shunt tube assembly, the entry device described herein may provide an alternate pathway for the slurry to enter into the shunt tube assembly. In an embodiment shown in FIG. 2, an entry device 200 may comprises one or more inlet ports 202 and a shroud 204 disposed about a wellbore tubular 120. The shroud 204 defines a chamber 210 between the shroud and the wellbore tubular 120, and the one or more inlet ports 202 may be in fluid communication with the chamber 210. The shunt tube 206 may also be in fluid communication with the chamber 210 such that the shunt tube 206 is in fluid communication with the one or more inlet ports 202 through the chamber 210.

The wellbore tubular 120 may comprise any of those types of wellbore tubular described above with respect to FIG. 1. In general, the wellbore tubular 120 comprises a generally tubular member having a flowbore disposed therethrough. The wellbore tubular 120 may not be in fluid communication with the chamber 210 at or near the entry device 200, and may form a substantially impermeable surface.

Figure 2:
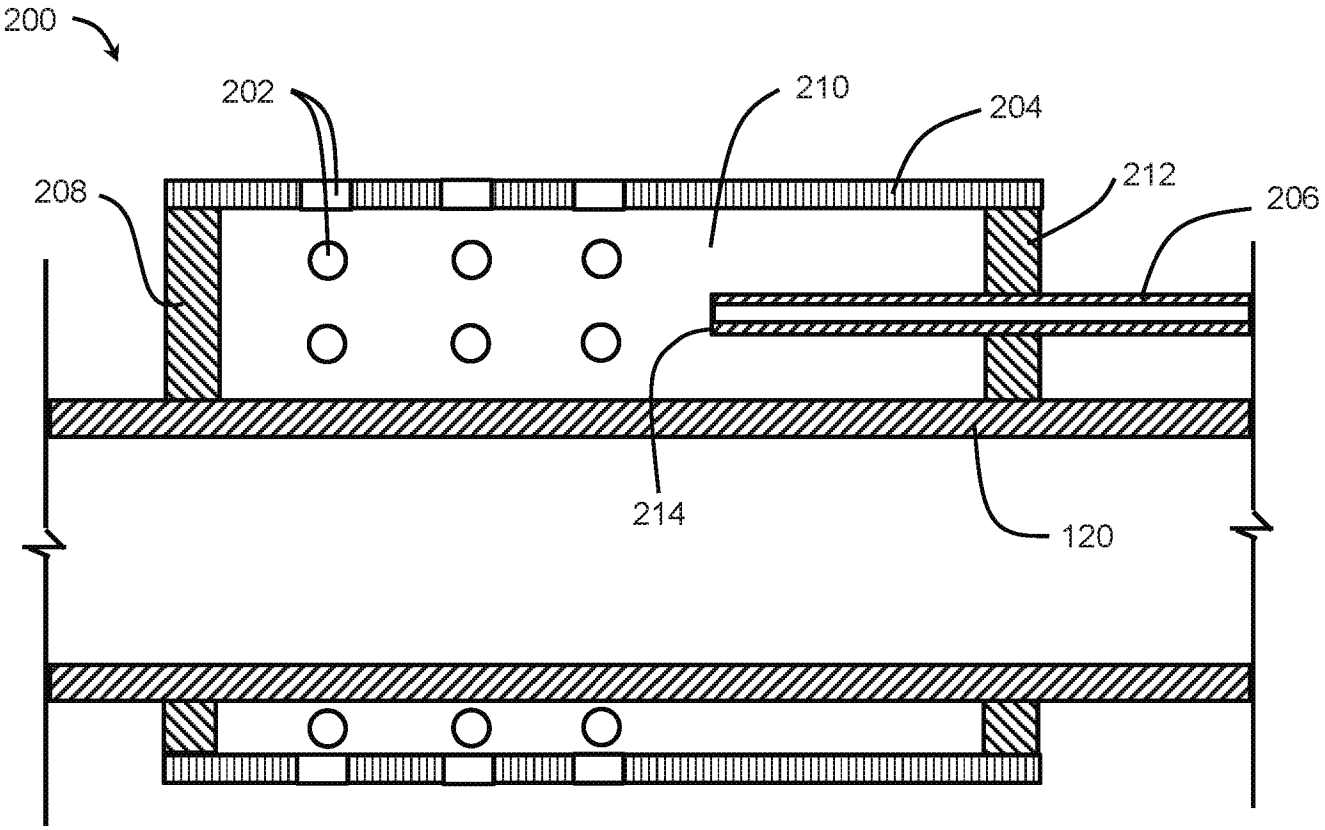
FIG. 2 is a cross-sectional view of an embodiment of an entry device.

The shroud 204 may comprise a generally tubular structure, or any portion thereof, that is disposed at least partially about the wellbore tubular 120. In an embodiment, the shroud 204 may comprise any suitable cover disposed adjacent the wellbore tubular 120 and configured to form a chamber 210 between the wellbore tubular 120 and the shroud 204. For example, the shroud 204 may comprise a portion of a tubular structure disposed about a portion of the wellbore tubular 120 (e.g., about half of the wellbore tubular 120), or the shroud 204 may comprise an entire tubular structure disposed about the entire circumference of the wellbore tubular 120. The shroud 204 may be concentrically disposed about the wellbore tubular 120. Due to the alignment of the one or more shunt tubes along the outer surface of the wellbore tubular 120, the shroud may be eccentrically disposed about the wellbore tubular 120 to provide additional area for routing the shunt tubes. The shroud may be retained in position about the wellbore tubular 120 using a number of configurations. As illustrated in FIG. 2, a first retaining ring 208 may be disposed about the wellbore tubular 120 and engage the wellbore tubular 120 and the shroud 204 using any suitable engagement (e.g., a threaded engagement, welded, brazed, etc.). A second retaining ring may be disposed about the wellbore tubular 120 and axially spaced apart from the first retaining ring 208. The second retaining ring 212 may engage the wellbore tubular 120 and the shroud 204 using any suitable engagement (e.g., a threaded engagement, welded, brazed, etc.), thereby defining the chamber 210 between the wellbore tubular 120, the shroud 204, the first retaining ring 208 and the second retaining ring 212. In an embodiment, the chamber 210 may provide fluid communication about the circumference of the wellbore tubular 120. One or more passageways may be disposed in the second retaining ring 212 to provide for fluid communication between the chamber 210 and the shunt tubes. In an embodiment, the one or more shunt tubes 206 may be coupled to the one or more passageways, and in some embodiments, may be disposed through the one or more passageways so that an end 214 of the shunt tube 206 can be disposed within the chamber 210. When multiple shunt tubes 206 are present, the ends 214 of the shunt tubes may be circumferentially spaced about the wellbore tubular 120. In an embodiment, the ends of the shunt tubes 206 may be evenly circumferentially spaced about the wellbore tubular 120 (e.g., 180 degrees apart for two shunt tubes, 120 degrees apart for three shunt tubes, etc.). Alternatively, the ends 214 of the shunt tubes may be unevenly spaced about the wellbore tubular 120, for example, to allow the shunt tubes to be disposed on one side of the wellbore tubular in an eccentric alignment.

While described in terms of separate retaining rings 208, 212 being used to engage and retain the shroud 204 in position, the retaining rings 208, 212 may be integrally formed with the shroud 204 and/or the retaining rings 208, 212 may comprise portions of the shroud 204. In an embodiment, the shroud 204 may comprise end portions that are formed at an angle with respect to the wellbore tubular 120, and the end portions may be configured to allow the end portions to engage the wellbore tubular 120. For example, the retaining rings 208, 212 may be replaced by end portions of the shroud 204 that are formed at a right angle with respect to the generally axial portion of the shroud comprising the one or more ports 202. Any other suitable angles may also be used, and/or any other suitable coupling mechanisms may be used to allow the shroud to engage the wellbore tubular.

In an embodiment, the one or more ports 202 may comprise one or more perforations in the shroud 204. While the wellbore tubular 120 is illustrated as being perforated with generally circular perforations in FIG. 2, the wellbore tubular 120 may be slotted and/or include perforations of any shape so long as the perforations permit fluid communication of the slurry from the exterior of the entry device 200 and into the chamber 210. The one or more ports 202 may be disposed over at least a portion of the shroud 204. In general, the one or more ports 202 may be disposed over a sufficient portion of the shroud 204 to provide for fluid communication between the exterior of the entry device 200 and the chamber 210. In an embodiment, the one or more ports 202 may be disposed over a circumferential ring about the shroud 204. In some embodiments, the one or more ports 202 may be disposed in longitudinal bands along the length of the shroud, and may cover substantially all of the shroud 204. In other embodiments, the one or more ports 202 may be disposed over only a portion of the shroud 204.

The one or more ports 202 may generally be sized to allow the sand and/or gravel within the slurry to pass through the one or more ports 202 to enter the shunt tube assembly. In some embodiments, the one or more ports 202 may be limited in size to prevent additional elements other than the sand and/or gravel within the slurry from passing into the chamber 210. In an embodiment, the one or more ports may be configured to prevent particular material or any other components larger than the nozzle opening and/or exit port size in the exit portion of the shunt tube assembly from passing through the entry device 200 (e.g., from passing into chamber 210). This may allow the entry device to act as a filtering element to prevent the potential clogging of the exit nozzle and/or openings. Further, the number and size of the ports 202 may be selected to provide a total cross section area that is greater than the cross-sectional flow area of the one or more shunt tubes 206. In an embodiment, the ratio of the total cross-section area through the one or more ports 202 to the cross-sectional flow area of the one or more shunt tubes 206 may be at least about 1.1:1, at least about 1.5:1, at least about 2:1, at least about 3:1, or at least about 4:1. In some embodiments, the number and size of the ports 202 may be selected to provide a total cross-section area available for flow through the one or more ports on each side of the entry device 200 that is greater than the cross-sectional flow area of the one or more shunt tubes 206. In an embodiment, the ratio of the total cross-section area through the one or more ports 202 on each side of the entry device 200 to the cross-sectional flow area of the one or more shunt tubes 206 may be at least about 1.05:1, at least about 1.25:1, at least about 1.5:1, at least about 1.75:1, or at least about 2:1.

In use, the entry device illustrated in FIG. 2 may provide an entrance path into the one or more shunt tubes 206 that may avoid potentially being clogged. Upon the formation of a sand bridge on the sand screen as described with respect to FIG. 1, a back pressure generated by the blockage may cause the slurry carrying the sand to be diverted through entry device 200. The slurry may enter the one or more perforations 202 and into the chamber 210. Once inside the chamber, the slurry may enter the shunt tube 206 and be conveyed into the remainder of the shunt tube assembly. Should a blockage such as a sand bridge form around a portion of the entry device 200, the slurry may be diverted to the ports 202 in the shroud 204 that are exposed to the slurry. The one or more ports 202 may prevent or reduce the blockage from forming within the chamber 210, thereby allowing the slurry to enter the one or more shunt tubes 206 despite the blockage.

Figure 3:
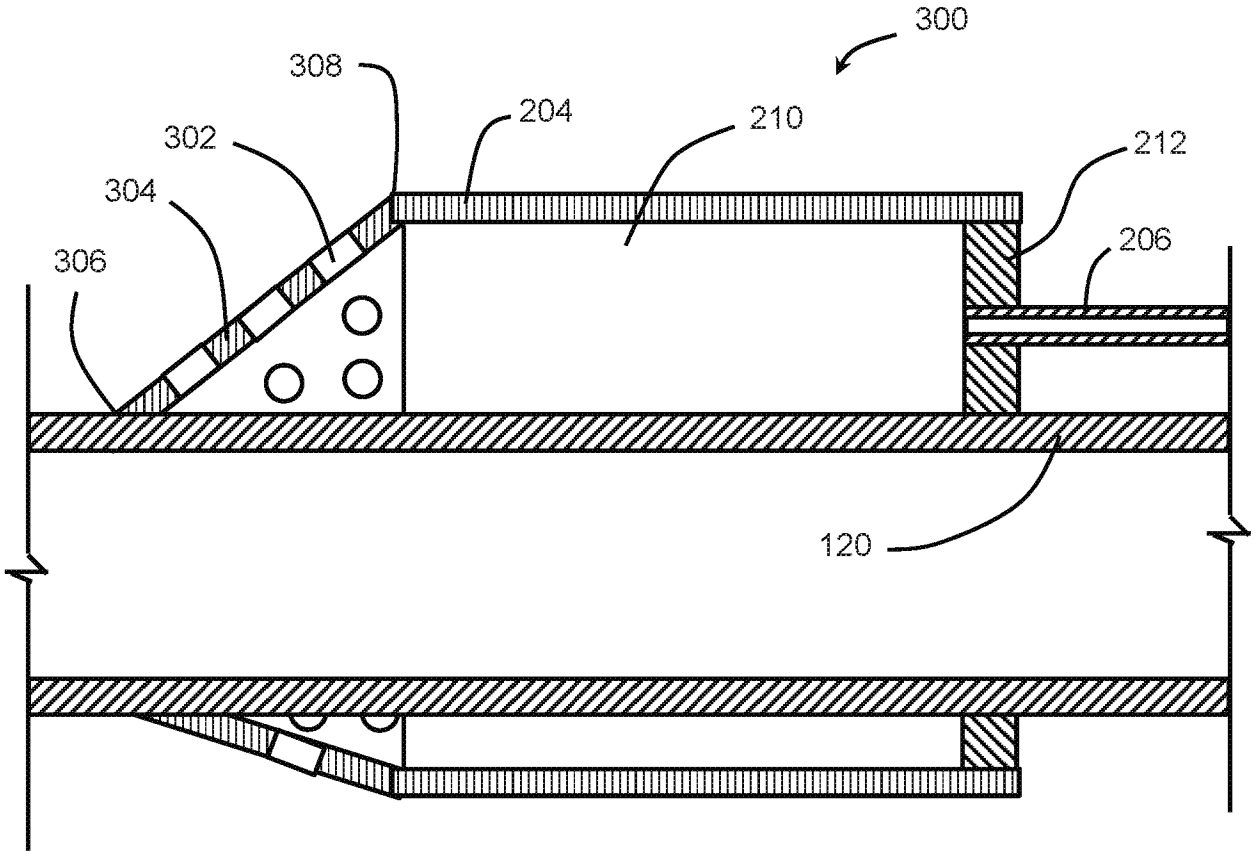
FIG. 3 is another cross-sectional view of an embodiment of an entry device.

Another embodiment of an entry device 300 is illustrated in FIG. 3. The entry device 300 is similar to the entry device 200 of FIG. 2, and similar parts will not be discussed in the interest of clarity. In this embodiment, the entry device 300 comprises one or more inlet ports 302 disposed on at least a portion of the shroud 204, which may be disposed about the wellbore tubular 120. As with the embodiment illustrated in FIG. 2, the shroud 204 defines a chamber 210 between the shroud 204 and the wellbore tubular 120, and the one or more inlet ports 302 may be in fluid communication with the chamber 210. The shunt tube 206 may also be in fluid communication with the chamber 210 such that the shunt tube 206 is in fluid communication with the one or more inlet ports 302 through the chamber 210.

The shroud 204 may comprise a first portion 304 that is angled with respect to the wellbore tubular 120 and configured to engage the wellbore tubular 120 at a first end 306. The first portion 304 may have diameter that expands at a second end 308, and the outer diameter may be the same or similar at the second end 308 as the remainder of the shroud 204. While illustrated as forming a generally frusto-conical shape, any other suitable shapes (e.g., beveled, tapered, chamfered, fillet, and the like) may be formed by the first portion 304 of the shroud, or in some embodiments, substantially all of the shroud 204.

In an embodiment, a second retaining ring 212 may be disposed about the wellbore tubular 120. The second retaining ring 212 may engage the wellbore tubular 120 and the shroud 204 using any suitable engagement (e.g., a threaded engagement, welded, brazed, etc.), thereby defining the chamber 210 between the wellbore tubular 120, the shroud 204, the first portion 304 of the shroud 204, and the second retaining ring 212. In some embodiments, a second end of the shroud adjacent the one or more shunt tubes 206 may be formed similarly to the first portion 304 of the shroud. For example, the second end may be shaped to comprise a generally frusto-conical shape or any other suitable shapes (e.g., beveled, tapered, chamfered, fillet, and the like). The second end may optionally comprise one or more ports. The non-squared edge of at least a portion of the shroud 204 may allow the entry device 300 to more easily traverse through the wellbore when the entry device 300 is conveyed within the wellbore. In addition, the positioning of the one or more ports 302 on the first portion 304 of the shroud 204 may allow the slurry flowing in the axial direction to more easily enter the chamber 210.

In use, the entry device 300 illustrated in FIG. 3 may provide an entrance path into the one or more shunt tubes 206 that may avoid potentially being clogged. Upon the formation of a sand bridge in the sand screen as described with respect to FIG. 1, a back pressure generated by the blockage may cause the slurry carrying the sand to be diverted through entry device 300. The slurry may enter the one or more perforations 302 formed in the first portion 304 of the shroud 204 and into the chamber 210. Once inside the chamber 210, the slurry may enter the shunt tube 206 and be conveyed into the remainder of the shunt tube assembly. Should a blockage such as a sand bridge form around a portion of the entry device 200, the slurry may be diverted to the ports in the shroud 204 that are exposed to the slurry. The one or more ports may prevent or reduce the blockage from forming within the chamber 210, thereby allowing the slurry to enter the one or more shunt tubes 206 despite the blockage.

Figure 4:
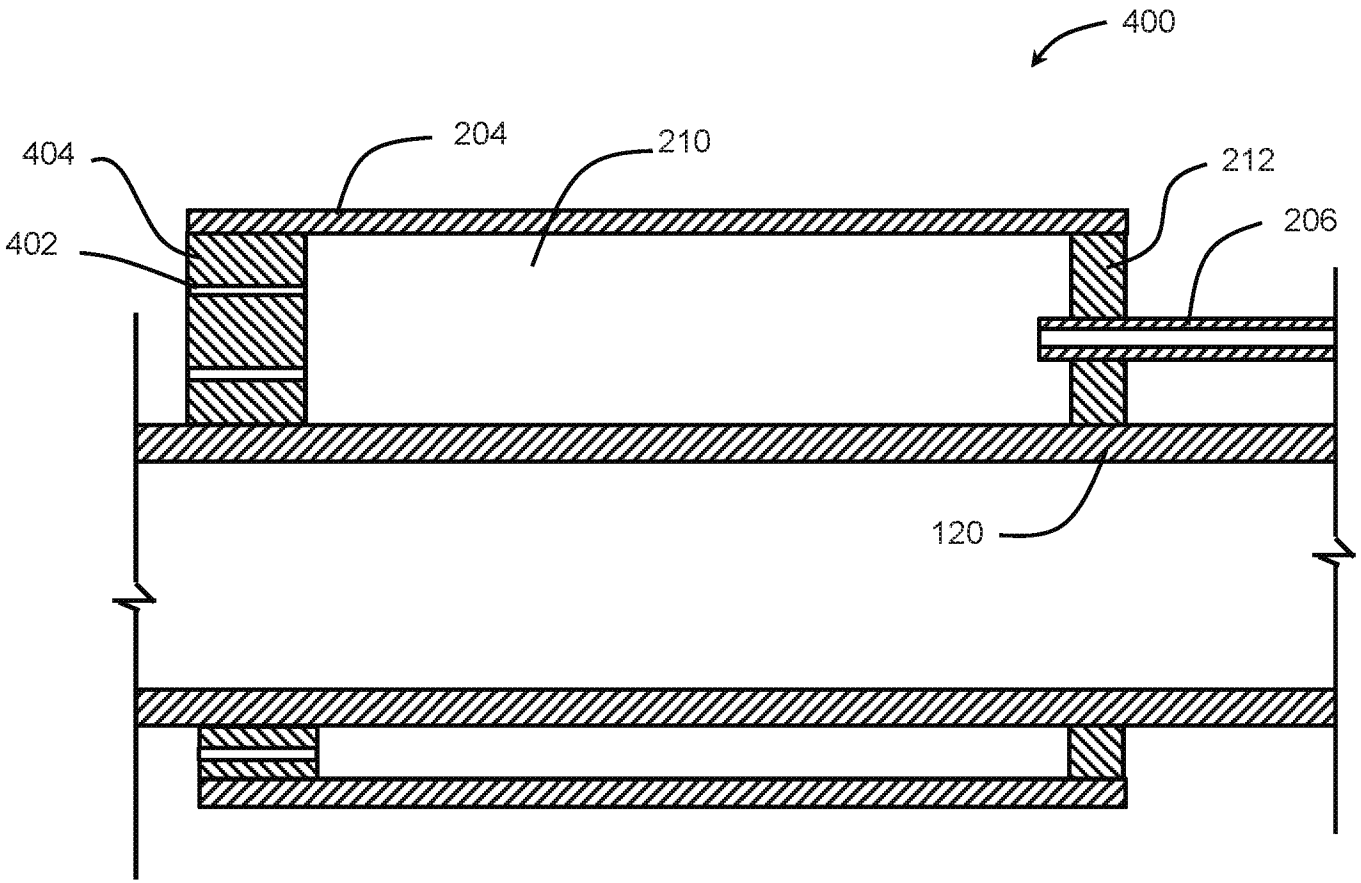
FIG. 4 is still another cross-sectional view of an embodiment of an entry device.

Still another embodiment of an entry device 400 is illustrated in FIG. 4. The entry device 400 is similar to the entry device 200 of FIG. 2, and similar parts will not be discussed in the interest of clarity. In this embodiment, the entry device 400 comprises one or more inlet ports 402 disposed in at least a portion of the first retaining ring 404. As with the embodiment illustrated in FIG. 2, the shroud 204 defines a chamber 210 between the shroud 204 and the wellbore tubular 120, and the one or more inlet ports 402 may be in fluid communication with the chamber 210. The shunt tube 206 may also be in fluid communication with the chamber 210 such that the shunt tube 206 is in fluid communication with the one or more inlet ports 402 through the chamber 210.

In an embodiment, the shroud 204 may be retained in position about the wellbore tubular 120 using a first retaining ring 404 and a second retaining ring 212. The first retaining ring 404 may be the same or similar to the first retaining ring discussed with respect to FIG. 2 with the exception that the one or more ports 402 may be disposed in the first retaining ring 404 rather than the shroud 204. The one or more ports 402 may comprise holes and/or tubes through the first retaining ring 404. For example, the one or more ports 402 may have a ratio of their length to diameter of greater than about 1.5:1, greater than about 2:1, greater than about 3:1, or greater than about 4:1. In an embodiment, the one or more ports 402 may comprise passageways having generally circular cross-section, though in some embodiments, the one or more ports may have square, rectangular, oval, triangular, or oblong cross-sectional shapes. In order to provide the one or more ports 402 with the appropriate dimensions, the first retaining ring 404 may comprise a corresponding axial length and radial height to provide for the appropriate size of the one or more ports 402. The use of tubular ports may help prevent the formation of blockages within the chamber 210 by providing a fluid pathway having an increased resistance to flow during the initial gravel packing operations. When the shunt tube assembly is needed, the use of the one or more ports 402 on the first retaining ring 404 may allow the slurry flowing in the axial direction to follow a relatively straight flow path into the chamber 210 from the exterior of the entry device 400.

In use, the entry device 400 illustrated in FIG. 4 may provide an entrance path into the one or more shunt tubes 206 that may avoid potentially being clogged. When needed, the slurry may enter the one or more ports 402 formed in the first retaining ring 404 and into the chamber 210. Once inside the chamber 210, the slurry may enter the shunt tube 206 and be conveyed into the remainder of the shunt tube assembly. Should a blockage such as a sand bridge form around a portion of the entry device 400, the slurry may be diverted to the ports 402 that are exposed to the slurry. The one or more ports may prevent or reduce the blockage from forming within the chamber 210, thereby allowing the slurry to enter the one or more shunt tubes 206 despite the blockage.

Figure 5A:
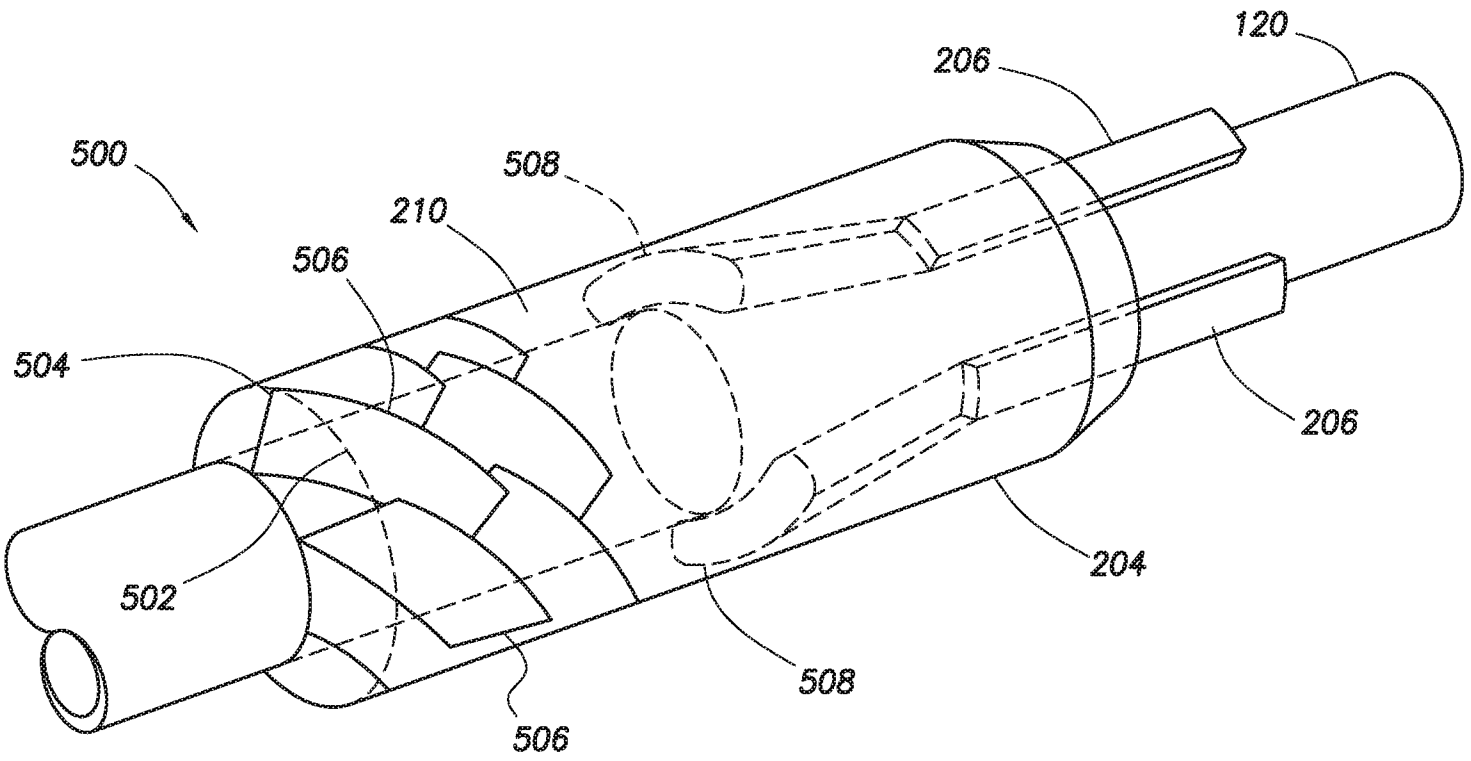
FIG. 5A is n schematic, isometric view of an embodiment of an entry device.
Figure 5B:
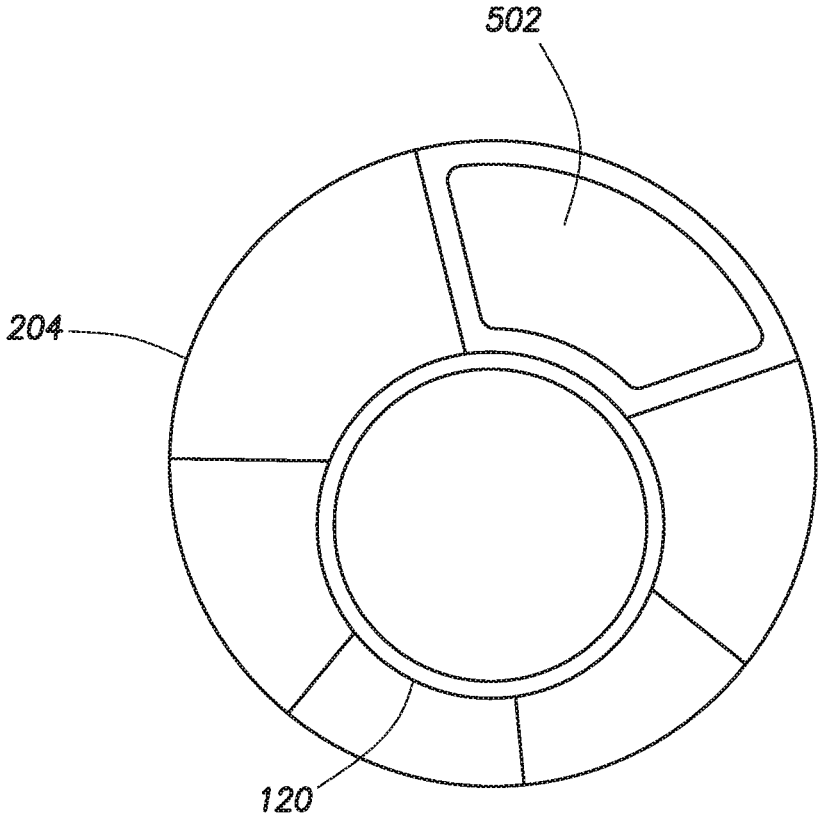
FIG. 5B is a cross-sectional view of an embodiment of an entry device.
Figure 5C:
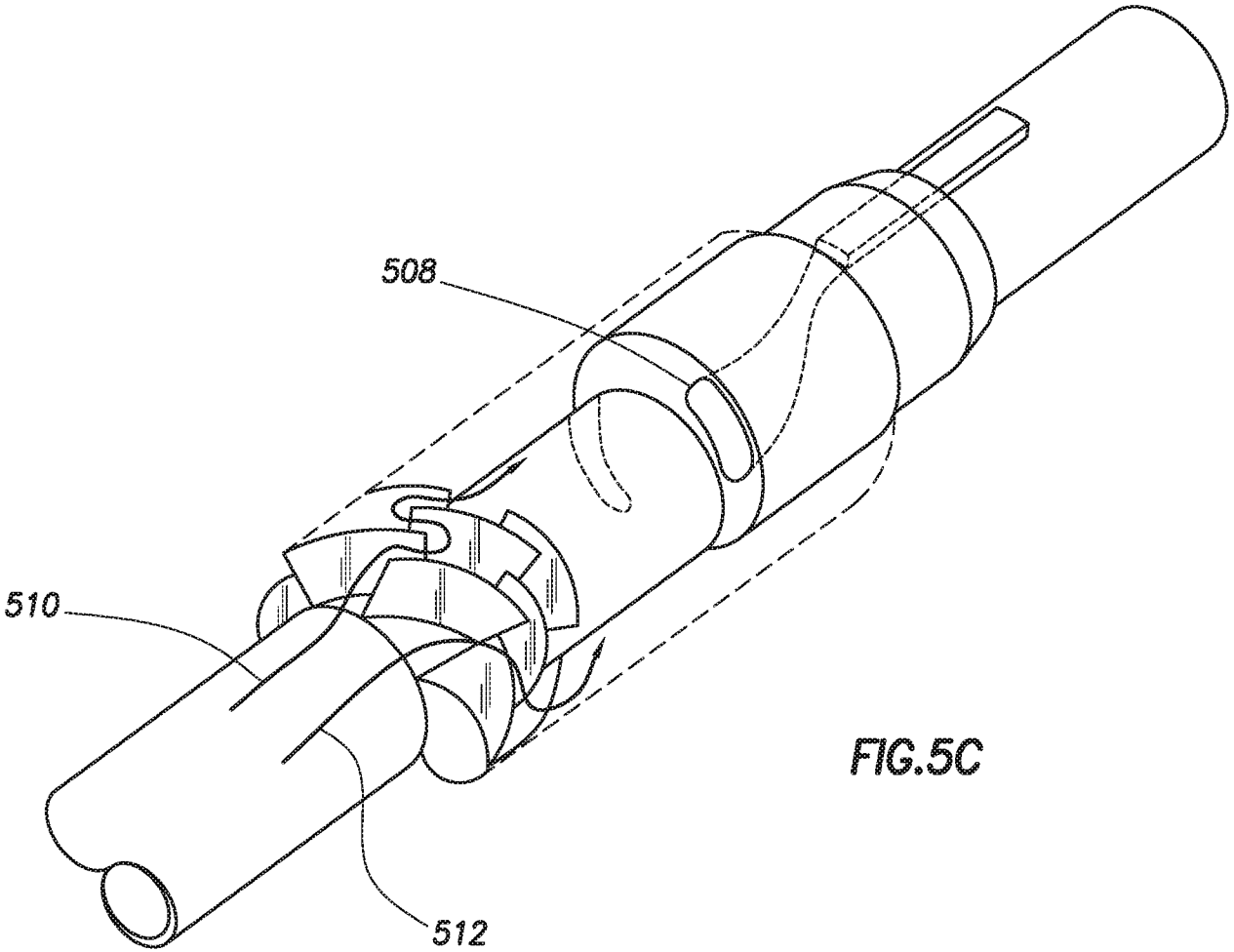
FIG. 5C is another isometric, partial cutaway view of an embodiment of an entry device.

An embodiment of an entry device 500 is illustrated in FIGS. 5A-5C. Portions of the entry device 500 are similar to the entry device 200 of FIG. 2, and similar parts will not be discussed in the interest of clarity. In this embodiment, the entry device 500 comprises one or more inlet ports 502 disposed in at least a first end 504 of the entry device 500. As with the embodiment illustrated in FIG. 2, the shroud 204 defines a chamber 210 between the shroud 204 and the wellbore tubular 120, and the one or more inlet ports 502 may be in fluid communication with the chamber 210. The one or more shunt tubes 206 may also be in fluid communication with the chamber 210 such that the shunt tubes 206 are in fluid communication with the one or more inlet ports 502 through the chamber 210.

As illustrated in FIG. 5B, the one or more ports 502 may comprise openings between adjacent baffles 506 to allow for fluid communication into the interior of the chamber 210. As discussed in more detail herein, the shroud 204 may be disposed concentrically or eccentrically about the wellbore tubular 120. When the shroud 204 is eccentrically disposed about the wellbore tubular 120, the corresponding ports 502 may have varying sizes to account for the varying inlet area available between the shroud and the wellbore tubular 120. One or more ends of the shroud 204 may be beveled or otherwise shaped to provide a non-square edge.

As illustrated in FIG. 5A, one or more internal baffles 506 may be disposed within the chamber 210. The baffles 506 may be configured to provide an elongated flow path for the slurry passing into the chamber 210. When the shunt tube assembly is not being used, the baffles 506 may serve to prevent or limit the formation of a blockage within the chamber 210 by slowing down any fluid flow through the baffles [[2]]506. When the shunt tube assembly is being used so that a slurry is being passed through the chamber 210, the baffles 506 may be configured to increase the amount of turbulent flow through the entry device 500. This turbulent flow may serve to entrain any sand that has settled within the chamber 210 with the slurry passing into the shunt tube assembly. This self-cleaning feature may be advantageous and at least partially remove any blockages that are formed at or near the entry device 500 during use.

The one or more baffles 506 may comprise generally radially extending blades, plates, and/or fins that may engage and/or contact the wellbore tubular 120 and/or the shroud 204. The baffles 506 may have a radial height and length that are much greater than their width, thereby having a relatively thin, plate-like structure. In an embodiment the baffles 506 can be coupled to both the wellbore tubular 120 and the shroud 204 and can serve to support and retain the shroud 204 in position about the wellbore tubular 120. Any suitable means of coupling the baffles to the wellbore tubular 120 and/or the shroud 204 may be used (e.g., bonding, welding, fasteners, etc.). While illustrated as a series of baffles 506, a single baffle 506 aligned in a spiral or helical configuration may also be used with the entry device 500.

The baffles 506 may be disposed in at least a portion of the chamber 210. In order to aid in preventing the formation of blockage within the chamber 210, the baffles 506 may be disposed adjacent the first end 504 of the entry device 500 comprising the one or more ports 502. The baffles 506 may extend from the first end 504 into the chamber a sufficient distance to provide for a turbulent flow of the slurry prior to entering the one or more shunt tubes 206. In an embodiment, the baffles 506 may extend over at least about 10%, at least about 20%, at least about 30%, at least about 40%, or at least about 50% of the axial length of the chamber 210.

The baffles 506 may generally be aligned at a non-parallel angle to the longitudinal axis of the wellbore tubular 120 (i.e., the axial direction). For example, the baffles 506 may be aligned at a normal angle to the longitudinal axis. In some embodiments, the baffles 506 may be aligned at a non-normal angle and a non-parallel angle to the longitudinal axis (e.g., between 90 degrees and 0 degrees with respect to the longitudinal axis). In an embodiment, each of the baffles 506 may be aligned at approximately the same angle with respect to the longitudinal axis, or one or more of the baffles may be aligned at different angles with respect to the longitudinal axis. When the baffles 506 are aligned at approximately the same angle with respect to the longitudinal axis, the baffles 506 may be configured to produce a swirling fluid flow about the wellbore tubular 120. For example, the baffles 506 illustrated in FIG. 5A may direct the flow in a swirling pattern about the wellbore tubular 120. This alignment may serve to remove a blockage at any point about the circumference of the chamber 210.

The ends 508 of the one or more shunt tubes 206 may extend into the chamber 210 to receive the slurry once it has passed through the one or more baffles 506. The flow area available through the ends 508 of the shunt tubes 206 maybe greater than the flow area through the shunt tubes 206 themselves downstream of the entry device 500 to provide a greater collection area into the shunt tubes 206. As discussed above with respect to FIG. 2, the ends 508 of the shunt tubes [[508]]206 may be evenly circumferentially spaced about the wellbore tubular 120 (e.g., 180 degrees apart for two shunt tubes, 120 degrees apart for three shunt tubes, etc.), or the ends 508 of the shunt tubes may be unevenly spaced about the wellbore tubular 120.

As illustrated in FIG. 5C, the entry device 500 may provide an entrance path into the one or more shunt tubes 206 that may avoid potentially being clogged. When needed, the slurry may enter the one or more ports 502 formed between adjacent baffles 506 and pass into the chamber 210. In an embodiment, the slurry may then follow a flow path 510 through the baffles and into the end 508 of the shunt tubes 206. In some embodiments, the slurry may follow a swirling flow path 512 through the baffles and into the end 508 of the shunt tubes 206. The selection of the flow path 510, 512 may be based on the design and configuration of the baffles within the chamber 210. The slurry may then enter the one or more shunt tubes 206 and be conveyed into the remainder of the shunt tube assembly. Should a blockage such as a sand bridge form around a portion of the entry device 500, the baffles 506 may create a flow pattern within the chamber 210 configured to remove and/or bypass the blockage.

Figure 6:
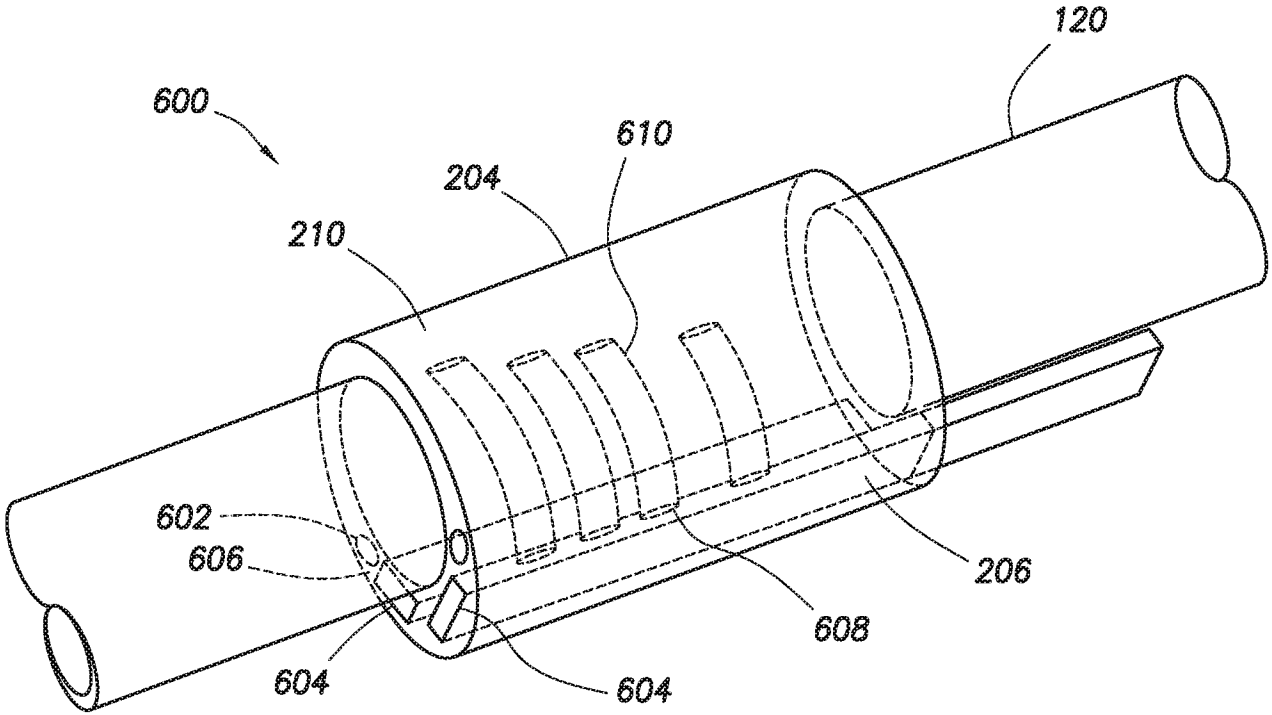
FIG. 6 is a schematic, isometric view of an embodiment of an entry device.

Another embodiment of an entry device 600 is illustrated in FIG. 6. The entry device 600 is similar to the entry device 200 of FIG. 2, and similar parts will not be discussed in the interest of clarity. In this embodiment, the entry device 600 comprises one or more inlet ports 602 disposed on an end 606 of the shroud 204 and/or a retaining ring. As with the embodiment illustrated in FIG. 2, the shroud 204 defines a chamber 210 between the shroud 204 and the wellbore tubular 120, and the one or more inlet ports 602 may be in fluid communication with the chamber 210. The end 604 of the one or more shunt tubes 206 may extend through the end 606 of the shroud 204 and be in fluid communication with the exterior of the entry device 600. One or more interior ports 608 may be provided in the one or more shunt tubes 206 within the chamber 210 to provide fluid communication between the chamber 210 and the one or more shunt tubes 206 within the chamber 210.

As illustrated in FIG. 6, the one or more inlet ports 602 can be disposed on an end 606 of the shroud 204 and/or a retaining ring. The one or more ports 602 may provide a fluid communication pathway into the interior of the chamber 210, and any number and combination of ports shapes and/or sizes may be used. While illustrated as being disposed on the end 606 of the shroud 204, the one or more ports 602 may alternatively or additionally be disposed on the outer surface of the shroud 204. In an embodiment, the chamber 210 may provide fluid communication around the circumference of the wellbore tubular 120, and the one or more ports 602 may then be in fluid communication with the chamber 210 about the entire circumference of the wellbore tubular 120.

The one or more shunt tubes 206 may extend through the shroud 204 and the chamber 210 to have one or more ends 604 of the shunt tubes 206 open to the exterior of the entry device 600. The open ends 604 may be the primary entrance points for the slurry to enter the shunt tubes 206. In addition to the one or more ends 604, one or more interior ports 608 may be provided in the shunt tubes 206 within the chamber 210. The one or more interior ports 608 may be the same or similar to any of the ports disclosed herein with respect to the ports in the shroud 204. The combination of the one or more ports 602 through the shroud 204, the chamber 210, and the one or more interior ports 608 may provide an alternate path for a fluid (e.g., the slurry) to enter the one or more shunt tubes 206.

In an embodiment, one or more optional extension tubes 610 may be coupled to one or more of the interior ports 608 and provide fluid communication between the corresponding interior port 608 and the end of the extension tube 610 within the chamber 210. The extension tubes 610 may comprise any type of flow cross-sectional shapes such as square, rectangular, oval, triangular, and/or oblong (e.g., forming slots). The extension tubes 610 may generally extend circumferentially within the chamber 210, though any orientation of the extension tubes 610 within the chamber 210 may be possible. When a plurality of extension tubes 610 are present, they may each have different lengths, or they may all be approximately the same length. The use of the extension tubes 610 may allow various portions of the chamber 210 to be accessible to the shunt tubes 206 if a blockage forms within the chamber 210. For example, if a blockage on a lower side of the chamber 210 covers the shunt tubes 206 and one or more interior ports 608, the extension tubes 610 may extend above the blockage to provide an alternate pathway for the slurry to enter the shunt tube assembly.

In use, the entry device 600 illustrated in FIG. 6 may provide an entrance path into the one or more shunt tubes 206 that may avoid potentially being clogged. Upon the formation of a sand bridge in the sand screen as described with respect to FIG. 1, the slurry carrying the sand may be diverted through entry device 600. The slurry may enter the ends 604 of the shunt tubes 206 to pass into the shunt tube assembly. If a blockage has formed and impedes the flow of the slurry through the ends 604 of the shunt tubes 206, the slurry may flow through the one or more perforations 602 formed in the shroud 204 and into the chamber 210. Once inside the chamber 210, the slurry may enter one or more of the interior ports 608 and be conveyed into the remainder of the shunt tube assembly. If a blockage has formed within the chamber 210 and impedes the flow of the slurry into the one or more interior ports 608, the slurry may flow through any optional extension tubes 610 coupled to the one or more interior ports 608. The slurry may then pass into the shunt tubes 206 and onto the remainder of the shunt tube assembly.

Figure 7A:
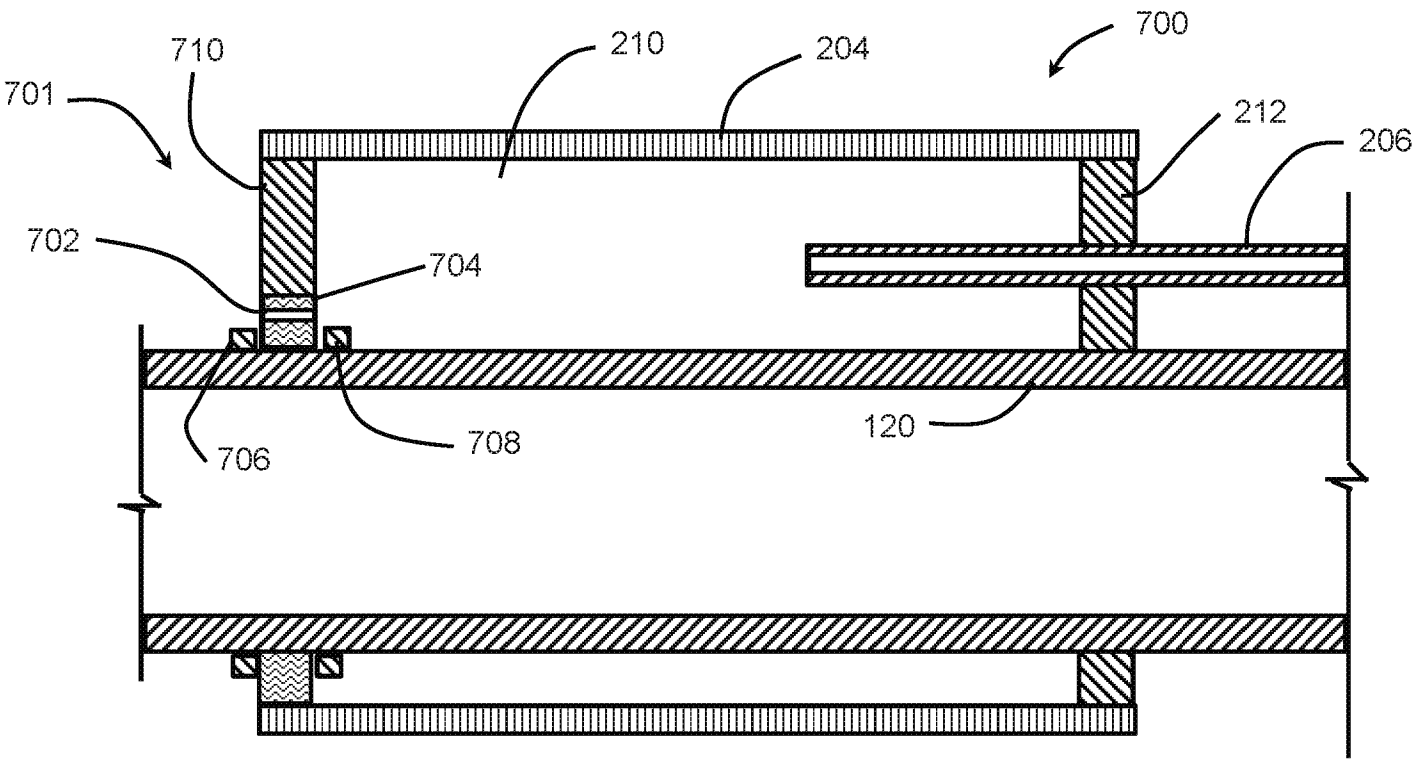
FIGS. 7A-7B are cross-sectional views of an embodiment of an entry device.
Figure 7B:
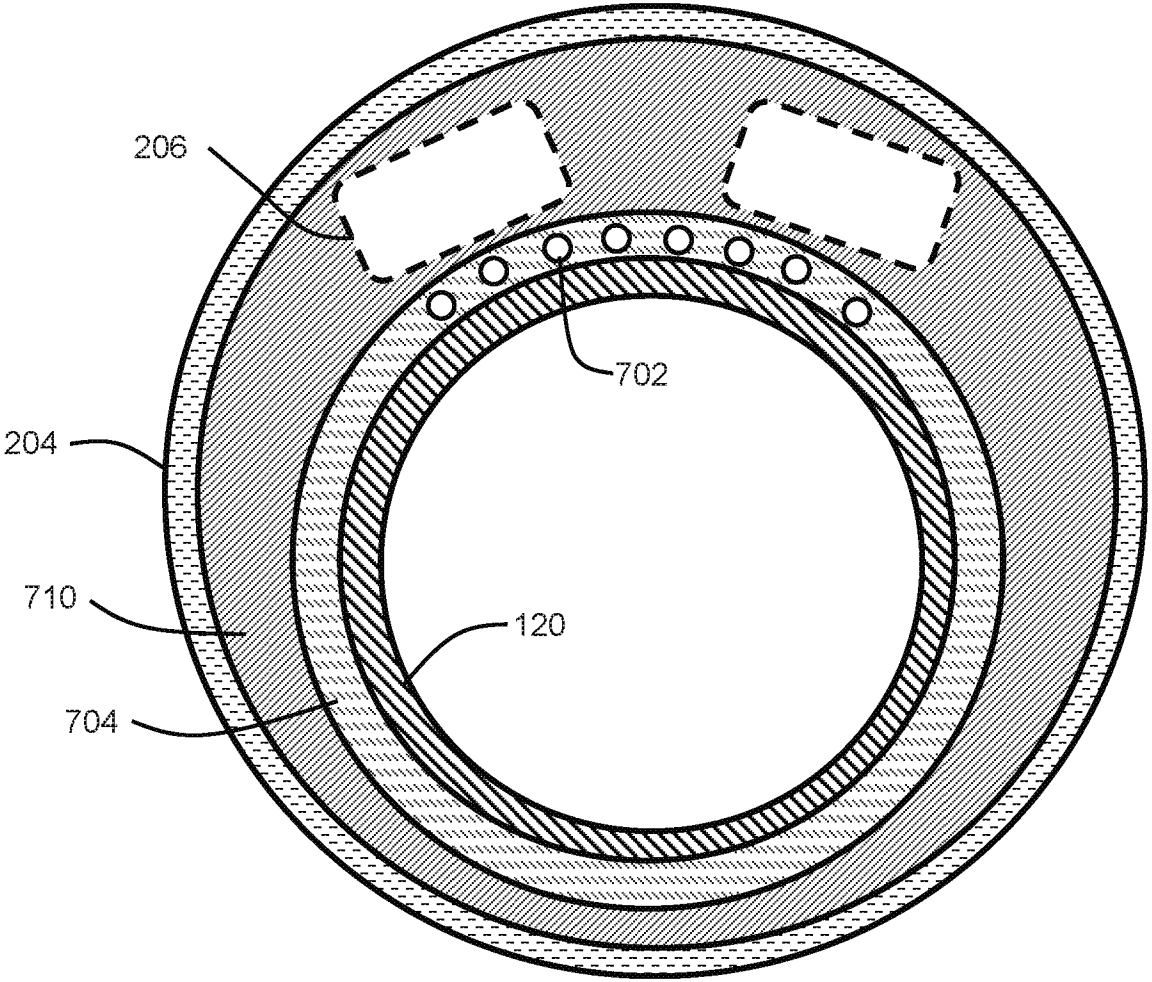

Another embodiment of an entry device 700 is illustrated in FIGS. 7A and 7B. The entry device 700 is similar to the entry device 200 of FIG. 2, and similar parts will not be discussed in the interest of clarity. In this embodiment, the entry device 700 comprises a self-aligning entrance subassembly 701. The entrance subassembly 701 comprises a rotatable ring 704 having one or more inlet ports 702 disposed therein and one or more retaining rings 706, 708 for axially retaining the rotatable ring 704 while allowing the rotatable ring 704 to rotate about the wellbore tubular 120. As with the embodiment illustrated in FIG. 2, the shroud 204 defines a chamber 210 between the shroud 204 and the wellbore tubular 120, and the one or more inlet ports 702 may be in fluid communication with the chamber 210. The one or more shunt tubes 206 may also be in fluid communication with the chamber 210 such that the shunt tube 206 is in fluid communication with the one or more inlet ports 702 through the chamber 210.

As illustrated in FIG. 7B, the entrance subassembly 701 may generally comprise a rotatable ring 704 disposed about the wellbore tubular 120. In an embodiment, the rotatable ring 704 is concentrically disposed about the wellbore tubular 120. A first retaining ring 710 may be disposed adjacent the rotatable ring 704 to retain the shroud 204 in position about the wellbore tubular 120. As illustrated, the shroud 204 may be disposed eccentrically about the wellbore tubular 120, though a concentric alignment may also be possible.

As illustrated in FIG. 7A, the rotatable ring 704 may comprise the one or more ports 702 in a portion of the rotatable ring, for example, in at least about two thirds, in at least about a half, or in at least about a third of the rotatable ring 704. The rotatable ring 704 may then be configured to rotate about the wellbore tubular 120 so that the one or more ports 702 are aligned at the top of the entrance subassembly 701. In this configuration, the one or more ports 702 may rise above a blockage that may form adjacent the entry device 700, which may generally form on a lower portion of the wellbore. In an embodiment, the rotatable ring 704 may rotate the one or more ports 702 to the top portion of the entrance subassembly 701 by being unevenly weighted, where the portion of the rotatable ring 704 comprising the one or more ports 702 is generally lighter than a portion on the opposite side of the rotatable ring 704. The one or more ports 702 may be sufficient to provide a portion of the rotatable ring 704 that is lighter than the opposite side. Alternatively, or in addition to the weight difference due to the one or more ports 702, a variation in the material selection, axial length, thickness, or other design parameters may be used to provide a heavier weight opposite the portion of the rotatable ring 704 comprising the one or more ports 702.

In an embodiment, the rotatable ring 704 may be retained between one or more retaining rings 706, 708 configured to axially retain the rotatable ring 704 while allowing the rotatable ring 704 to rotate about the wellbore tubular 120. One or more bearings may be used between the rotatable ring 704 and the wellbore tubular 120 and/or the retaining rings 706, 708 to allow the rotatable ring 704 to rotate about the wellbore tubular 120. In an embodiment, the rotatable ring 704 may be coupled to the first retaining ring 710, which may be configured to axially retain the rotatable ring 704 while allowing the rotatable ring 704 to rotate about the wellbore tubular 120.

In an embodiment, a second retaining ring 212 may be disposed about the wellbore tubular 120. The second retaining ring 212 may engage the wellbore tubular 120 and the shroud 204 using any suitable engagement (e.g., a threaded engagement, welded, brazed, etc.), thereby defining the chamber 210 between the wellbore tubular 120, the shroud 204, the entrance subassembly 701, and the second retaining ring 212.

In use, the entry device 700 illustrated in FIGS. 7A and 7B may provide an entrance path into the one or more shunt tubes 206 that may avoid potentially being clogged. When disposed in the wellbore in a deviated or horizontal wellbore, the rotatable ring 704 in the entrance subassembly 701 may rotate due to a weighting difference between a portion of the rotatable ring 704 comprising one or more ports 702 and a portion on an opposite side of the rotatable ring 704 that may be heavier. The portion of the rotatable ring 704 comprising one or more ports 702 may rotate to the high side of the wellbore. When the shunt tube assembly is needed, the slurry may enter the one or more ports 702 in the rotatable ring 704. It is expected that if any blockage forms adjacent the entry device 700, it would likely form on the low side of the wellbore, leaving one or more of the ports 702 on the high side of the wellbore open for receiving the slurry and allowing the slurry to flow into the chamber 210. Once inside the chamber 210, the slurry may enter the shunt tube 206 and be conveyed into the remainder of the shunt tube assembly.

In an embodiment, an entry device may also comprise a plurality of chambers. For example, a shunt tube entry device can comprise a plurality of inlet ports, a shroud disposed about a wellbore tubular, one or more dividers disposed between the shroud and wellbore tubular. The one or more dividers may define a plurality of chambers between the shroud and the wellbore tubular, and each of the plurality of chambers may be in fluid communication with one or more of the plurality of entry ports. Each of one or more shunt tubes may be in fluid communication with at least one of the plurality of chambers. In various embodiments, the plurality of chambers may be arranged in parallel and/or series.

Figure 8A:
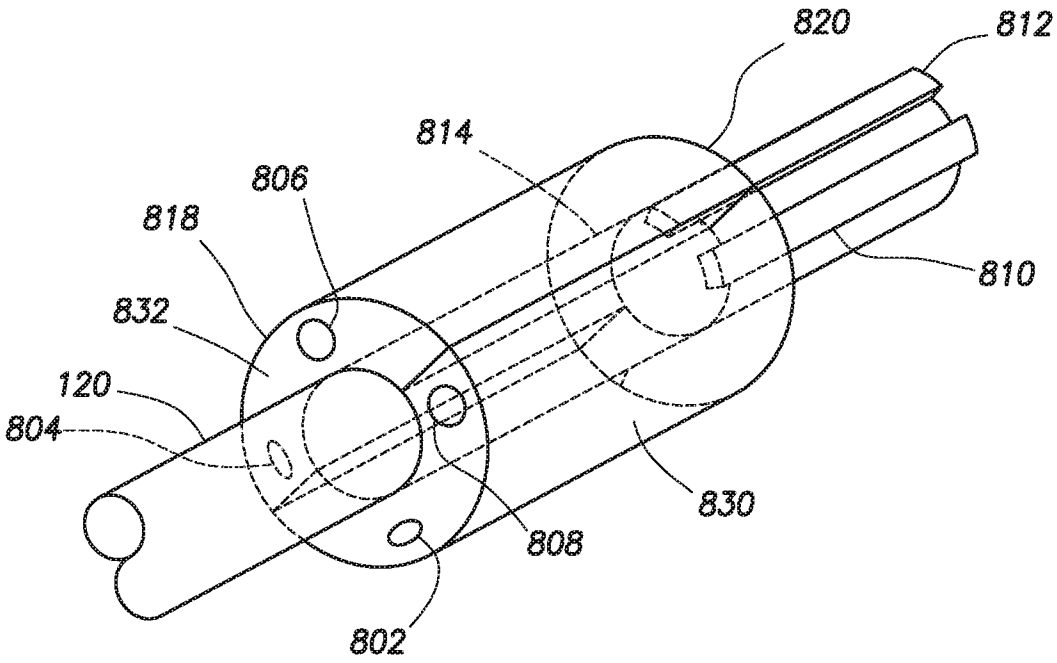
FIG. 8A is another schematic, isometric view of an embodiment of an entry device
Figure 8B:
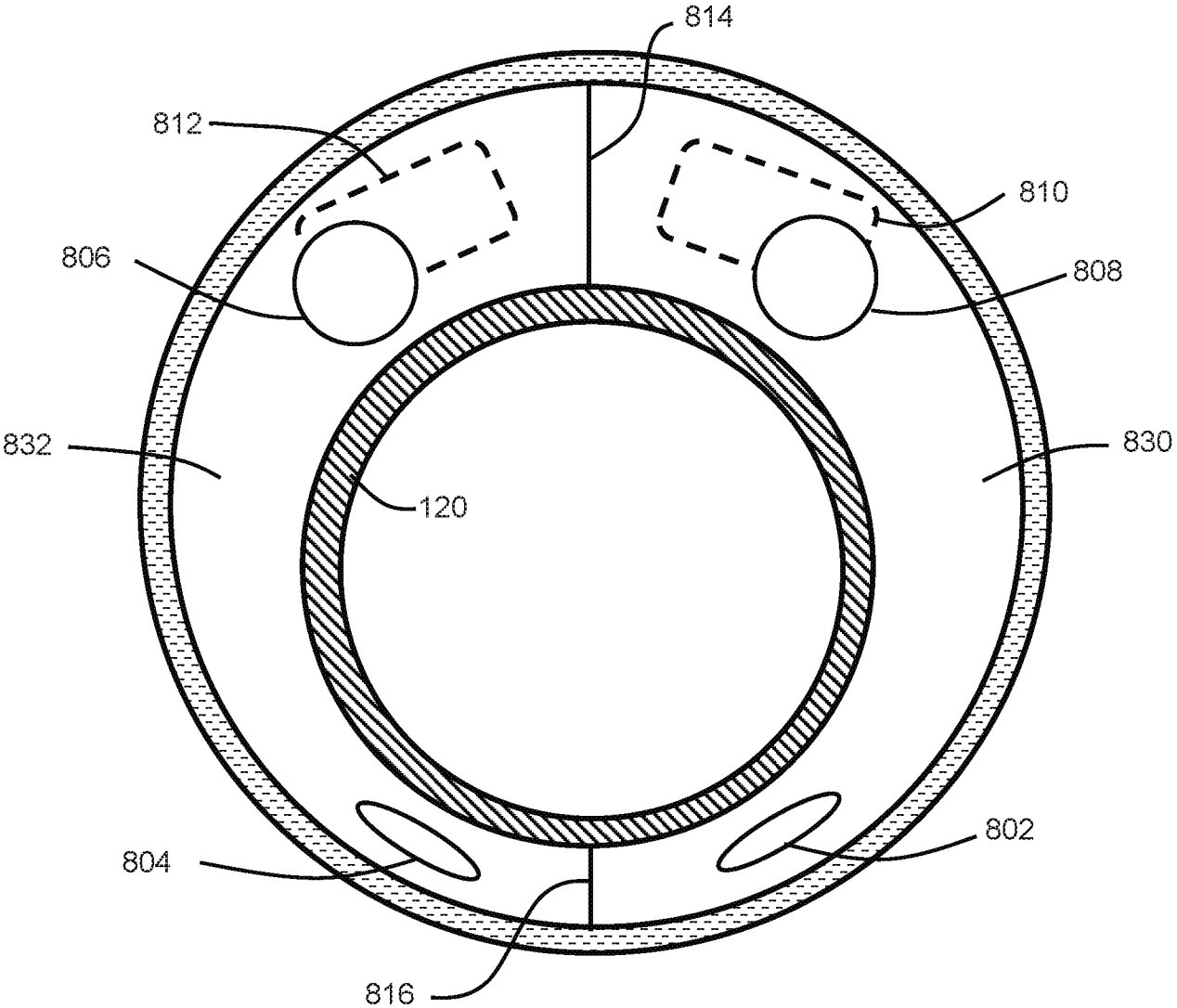
FIG. 8B is a cross-sectional view of an embodiment of an entry device.

An embodiment of an entry device 800 comprising a plurality of chambers is illustrated in FIGS. 8A and 8B. The portions of the entry device 800 that are similar to the entry device 200 of FIG. 2 will not be discussed in the interest of clarity. In this embodiment, the entry device 800 comprises one or more inlet ports 802, 804, 806, 808 providing fluid communication into the entry device 800. One or more dividers 814, 816 may be disposed between the shroud 204 and the wellbore tubular 120, and the one or more dividers 814, 816 may define a plurality of chambers 830, 832. A plurality of shunt tubes 810, 812 may be in fluid communication with the chambers 830, 832 such that each of the plurality of shunt tubes 810, 812 is in fluid communication with at least one of the plurality of chambers 830, 832.

In the embodiment, the dividers 814, 816 may generally comprise radial extensions sealingly engaged with both the wellbore tubular 120 and the shroud 204. The dividers 814, 816 may generally extend axially between a first end 818 of the shroud 204 and a second end 820 of the shroud 204, though other configurations such as spiral, helical, and/or angled dividers are also possible. The dividers 814, 816 may thereby form two chambers 830, 832 that are arranged in parallel. Additional dividers could be used to form additional chambers, for example, when additional shunt tubes are present.

Each of the plurality of chambers 830, 832 is in fluid communication with one or more of the ports 802, 804, 806, 808. For example, ports 802, 808 may be in fluid communication with the first chamber 830 while ports 804, 806 may be in fluid communication with the second chamber 832. Similarly, at least one shunt tube may be in fluid communication with each chamber 830, 832. For example, shunt tube 810 may be in fluid communication with chamber 830, and shunt tube 812 may be in fluid communication with chamber 832. It will be appreciated that the dividers 814, 816, ports 802, 804, 806, 808, and shunt tubes 810, 812 may be configured to provide fluid communication between any combination of the plurality of ports and the plurality of shunt tubes. While described in terms of the one or more ports being disposed on a first end 818 of the shroud, any of the ports described herein may be used at any location on the shroud 204. Further, any of the considerations for the number and size of the ports in the shroud 204 as described herein may also apply to the entry device 800.

In use, the entry device 800 illustrated in FIGS. 8A and 8B may provide an entrance path into the one or more shunt tubes 206 that may avoid potentially being clogged. Upon the formation of a sand bridge in the sand screen as described with respect to FIG. 1, the slurry carrying the sand may be diverted through entry device 800. The slurry may enter the one or more perforations 802, 804, 806, 808 formed in the shroud 204 and flow into a corresponding chamber 830, 832. Once inside one of the chambers 830, 832, the slurry may enter the corresponding shunt tube 810, 812 in fluid communication with the chamber 204. The slurry may then be conveyed through the corresponding shunt tube into the remainder of the shunt tube assembly. The one or more ports in fluid communication with each chamber may be circumferentially spaced apart. Should a blockage form over a portion of the shroud, the slurry may flow through any portion of the ports available for flow, which may include one or more of the chambers. The use of a plurality of chambers may provide additional flow paths in the event that flow through one of the chambers is impeded by a blockage.

Figure 9:
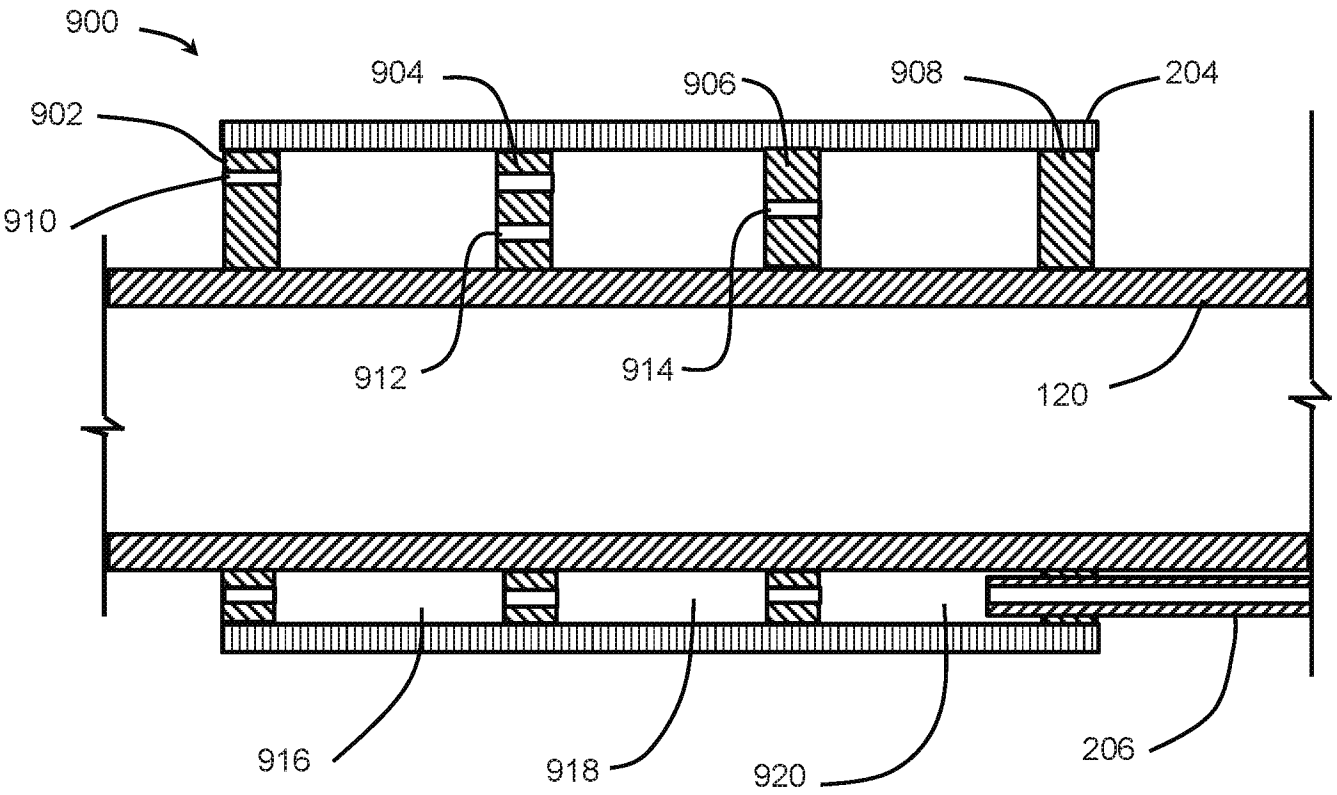
FIG. 9 is a cross-sectional view of an embodiment of an entry device.

Another embodiment of an entry device 900 is illustrated in FIG. 9. The portions of the entry device 900 that are similar to the entry device 200 of FIG. 2 will not be discussed in the interest of clarity. In this embodiment, the entry device 900 comprises one or more first inlet ports 910 providing fluid communication into a first chamber 916 defined between the shroud 204 and the wellbore tubular 120. One or more dividers 904, 906 may be disposed between the shroud 204 and the wellbore tubular 120 and define a plurality of chambers 916, 918, 920. Internal ports 912, 914 may provide fluid communication between each of the chambers 916, 918, 920, which may be arranged in series. For chambers arranged in series, the chambers may be represented as sub-chambers within a larger chamber, where the sub-chambers are separated by one or more dividers having one or more internal ports disposed therein. One or more shunt tubes 206 may be in fluid communication with the chambers 916, 918, 920. In this embodiment, the plurality of chambers 916, 918, 920 may serve to limit the formation of a blockage in the chambers 916, 918, 920, thereby allowing for alternate flow paths for a slurry to enter the shunt tube assembly.

In an embodiment, the dividers 904, 906, which may be the same or similar to the first retaining ring 902 and/or the second retaining ring 908, may generally comprise radial extensions sealingly engaged with both the wellbore tubular 120 and the shroud 204. The dividers 814, 816 may generally extend circumferentially about the wellbore tubular 120, though other configurations such as spiral, helical, and/or angled dividers are also possible while providing for chambers arranged in series. The dividers 904, 906, along with the first retaining ring 902 and the second retaining ring 908, may thereby form three chambers 916, 918, 920 that are arranged in parallel. Additional dividers could be used to form additional chambers.

One or more ports 910 disposed in the first retaining ring 902 may provide fluid communication into the first chamber 916. While described in terms of the ports 910 being disposed in the first retaining ring 902, it will be appreciated that the one or more ports 910 could also be disposed in the shroud disposed in contact with the first chamber 916. The one or more ports 910 in fluid communication with the first chamber 916 may be circumferentially spaced apart. Internal ports 912, 914 may provide fluid communication between each of the chambers 916, 918, 920. The one or more ports 910 and/or the internal ports 912, 914 may be the same or similar to any of the ports described herein, including, ports of various cross-section, tubes of various cross section, and/or baffles disposed in one or more of the chambers 916, 918, 920. The one or more internal ports may be circumferentially spaced apart. The number, size, type, and location of the ports 910 and the internal ports 912, 914 may all be the same or different. One or more shunt tubes 206 may be in fluid communication with the chamber 920, which may provide fluid communication with each of the other chambers 916, 918. While illustrated as comprising three chambers 916, 918, 920, any plurality of chambers may be formed with an appropriate number of dividers.

In use, the entry device 900 illustrated in FIG. 9 may provide an entrance path into the one or more shunt tubes 206. When a sand bridge is formed, the slurry may enter the one or more ports 910 formed in the first retaining ring 902 and/or the shroud 204 and flow into the first chamber 916. Once inside one of the first chamber 916, the slurry may flow through interior ports 912 into chamber 918. Similarly, the slurry may then flow through the interior ports 914 into chamber 920. From chamber 920, the slurry may enter the one or more shunt tubes 206. The slurry may then be conveyed through the corresponding shunt tube into the remainder of the shunt tube assembly. The one or more ports in fluid communication with each chamber may be circumferentially spaced apart. Should a blockage form over a portion of the shroud, the slurry may flow through any portion of the ports available for flow.

Having described the individual operation of each embodiment, any of the entry devices described herein may be used to form a gravel pack in a wellbore. In an embodiment, a gravel packing operation may be performed and a sand bridge may be formed along the interval being packed. Upon the formation of a sand bridge, a back pressure generated by the blockage may cause the slurry carrying the sand to be diverted through the one or more entry devices and into the shunt tubes to bypass the sand bridge. When the slurry carrying the sand is diverted through the one or more entry devices, the slurry may pass through one or more ports and be received within a chamber defined by the shroud disposed about the wellbore tubular. The slurry may then be passed and flow from the chamber into the one or more shunt tubes. The slurry may then pass out of the one or more shunt tubes into the one or more packing tubes. While flowing through the one or more packing tubes, the slurry may pass through the perforations in both the packing tubes and outer body member and into the annular space about the outer body member to form a gravel pack.

Entry devices comprising a plurality of chambers may also be used in a gravel packing operation. For example, the slurry carrying the sand may be divided into a plurality of portions by entering a entry device comprising a plurality of chambers arranged in parallel. A first portion of the slurry may flow through the entry device as described above. A second portion of the slurry may be received within a second chamber, where the second chamber is defined by one or more dividers disposed between the shroud and the wellbore tubular. The second portion of the slurry may be passed into one or more secondary shunt tubes, and the second portion of slurry may then be disposed about the sand screen assembly. Similarly, entry devices comprising a plurality of chambers arranged in series may also be used. For example, the chamber described above may comprise a first sub-chamber and a second sub-chamber. The first sub-chamber and the second sub-chamber may be defined by one or more dividers disposed between the shroud and the wellbore tubular. The slurry may be received within the first sub-chamber, passed from the first sub-chamber through one or more internal ports, received in the second sub-chamber through the one or more internal ports, and passed from the second sub-chamber into the one or more shunt tubes.

While the operation of the shunt tube assembly described herein has been described with regard to a gravel packing operation, one of ordinary skill in the art will appreciate that the system and methods disclosed herein may also be used for fracture operations and frac-pack operations where a fluid containing particulates (e.g., proppant) is delivered at a high flow rate and at a pressure above the fracture pressure of the subterranean formation such that fractures may be formed within the subterranean formation and held open by the particulates to prevent the production of fines into the wellbore.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A method of gravel packing comprising:

passing a slurry through one or more inlet ports into a first chamber defined by a shroud at least partially disposed about a wellbore tubular via one or more baffles, wherein each of the baffles are disposed between the shroud and the wellbore tubular at a non-axial and non-normal angle to a longitudinal axis of the wellbore tubular;

passing the slurry from the first chamber into one or more shunt tubes, wherein the one or more shunt tubes are in fluid communication with the first chamber, wherein passing a slurry through one or more inlet ports into at least one flow path defined between one or more baffles comprises directing the slurry into a swirling flow path;

disposing the slurry about a sand screen assembly;

receiving a second portion of the slurry within a second chamber, wherein the second chamber is defined by one or more dividers disposed between the shroud and the wellbore tubular; and passing the second portion of the slurry into one or more secondary shunt tubes; and disposing the second portion of slurry about the sand screen assembly.

2. The method of claim 1, wherein the second chamber comprises a first sub-chamber and a second sub-chamber, wherein the first sub-chamber and the second sub-chamber are defined by one or more dividers disposed between the shroud and the wellbore tubular, and wherein passing the slurry from the chamber into one or more shunt tubes comprises:

receiving the slurry within the first sub-chamber;

passing the slurry from the first sub-chamber through one or more internal ports;

receiving the slurry in the second sub-chamber through the one or more internal ports; and passing the slurry from the second sub-chamber into the one or more shunt tubes. tubes.

* * * * *